US006343911B1

(12) United States Patent
Burdgick

(10) Patent No.: US 6,343,911 B1
(45) **Date of Patent: *Feb. 5, 2002**

(54) SIDE WALL COOLING FOR NOZZLE SEGMENTS FOR A GAS TURBINE

(75) Inventor: Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/543,460

(22) Filed: Apr. 5, 2000

(51) Int. Cl.[7] ..... F01D 9/04; F01D 9/06

(52) U.S. Cl. ..... 415/115; 415/114; 415/116; 415/139

(58) Field of Search ..... 415/114, 115, 415/116, 117, 138, 139; 416/96 R, 96 A, 97 R

(56) References Cited

U.S. PATENT DOCUMENTS 3,807,892 A * 4/1974 Frei et al. ..... 415/116
5,116,199 A * 5/1992 Ciokajlo ..... 415/116
5,634,766 A 6/1997 Cunha et al.
5,823,741 A * 10/1998 Predmore et al. ..... 415/139
6,126,389 A * 10/2000 Burdgick ..... 415/115

* cited by examiner

*Primary Examiner*—Christopher Verdier
(74) *Attorney, Agent, or Firm*—Nixon & Vanderhye

(57) ABSTRACT

A nozzle vane segment includes outer and inner band portions with a vane extending therebetween and defining first and second cavities separated by an impingement plate for flowing cooling medium for impingement cooling of nozzle side walls. The side wall of each nozzle segment has an undercut region. The impingement plate has an inturned flange with a plurality of openings. Cooling inserts or receptacles having an open end are received in the openings and the base and side walls of the receptacles have apertures for receiving cooling medium from the first cavity and directing the cooling medium for impingement cooling of the side wall of the nozzle segment and a portion of the nozzle wall.

18 Claims, 2 Drawing Sheets

SIDE WALL COOLING FOR NOZZLE SEGMENTS FOR A GAS TURBINE

This Invention was made with Government support under Contract No. DE-FC21-95MC31176 awarded by the Department of Energy. The Government has certain rights in this invention.

BACKGROUND OF THE INVENTION

The present invention relates to impingement cooling of a gas turbine nozzle segment side wall and particularly relates to cooling inserts for targeting impingement cooling flows along the nozzle side wall.

Land-based gas turbines are used for the generation of electrical power. In a current turbine design, certain parts of the rotor including the turbine buckets, as well as certain fixed parts including nozzle segments, are cooled by flowing a cooling medium, e.g., steam, through the parts. For example, nozzle segments each having outer and inner band portions with one or more vanes extending therebetween are arranged in a circular or annular array about the rotational axis of the turbine to define and form part of the hot gas path through the turbine. Generally, the outer band portion of each nozzle segment has a nozzle wall forming part of the hot gas path and a cover radially outwardly of the nozzle wall defining a cooling chamber. An impingement plate is disposed in the chamber defining first and second cavities on opposite sides of the impingement plate with the cover and nozzle wall, respectively. A cooling medium, e.g., steam, flows into the first cavity and through multiple apertures in the impingement plate for impingement cooling the nozzle wall. The post-impingement cooling medium flows from the second cavity into cavities within the vane(s) which typically have inserts for impingement cooling the side walls of the vane. The cooling medium then flows into the inner band portion of the nozzle segment which, like the outer band portion, is divided into first and second cavities. The flow from the vane cavities thus flows into a first cavity, and reverses direction for flow through apertures in an impingement plate for impingement cooling the inner nozzle wall. The spent cooling medium then flows outwardly through one or more cavities of the vane to a cooling medium exhaust.

In a current nozzle segment design, the cover is welded to the nozzle side walls or edges locating the weld joint close to the hot gas path. The weld joint is therefore subjected to the high temperatures of the flowing hot gas. In that design, nozzle side wall cooling is very difficult and the weld joint is a life-limiting location. Due to fabrication/assembly requirements of the impingement plate, a substantial distance is created in which the cooling medium must traverse to impingement cool the nozzle side wall or edge. This distance reduces the effectiveness of the impingement cooling at the side wall. Thus, the current weld joint between the nozzle side wall and its cover has reduced fatigue life due to the geometry of the location of the weld and the temperature at that location. It will also be appreciated that when providing a weld at that location, weld distortion can change the thickness of the weld joint. If the joint becomes too thin, structural strength is sacrificed. Moreover, for each weld joint, there is a reduction in cycle life. Thus, for welds of various thicknesses, the stresses increase, low cycle fatigue decreases and the life of the parts is severely limited. Also, the machining preparation for the weld joint at its current location is critical and the design is very sensitive to manufacturing tolerances. As indicated previously, impingement cooling of the band edge becomes ineffective and less than optimum because of the substantial distances traversed by the flow of the cooling medium from the impingement plate apertures to the side wall.

BRIEF SUMMARY OF THE INVENTION

In a preferred embodiment of the present invention, a cooling system is provided in a nozzle segment wherein the weld joint between the side wall and cover is displaced radially away from the hot gas path to a location on the side of the spline seal between adjacent nozzle segments remote from the nozzle wall exposed to the hot gas path. That weld location assures that the weld thickness is not a variable and that the weld does not require subsequent machining. Moreover, by locating the weld a substantial distance from the hot gas path, the life of the weld joint and the producibility of the joint is vastly improved. It remains necessary, however, to cool the side wall of each nozzle segment. The cooling scheme of the present invention provides for the producibility of the complex cooling required at the band edges and reduces the distance between the impingement apertures and the side wall to provide effective side wall impingement cooling.

To accomplish the foregoing, the nozzle side wall has an inturned flange defining with the side wall and portion of the nozzle wall an undercut region. The cover is welded to the inturned flange of the nozzle segment at a location spaced from the hot gas path. For example, in the case of the outer band, the weld joint is located outwardly of the edge spline seal between adjacent nozzle segments. To provide impingement cooling for the nozzle side wall or edge, the impingement plate disposed in the chamber defined between the nozzle wall and the cover has an inturned edge which is welded to the inturned flange of the nozzle side wall. The undercut region defined by the inturned flange, the nozzle side wall, and a portion of the nozzle wall defining part of the hot gas path is of substantial volume. Moreover, the distances between the impingement plate and the walls defining the undercut region are sufficiently large that cooling flow through the apertures of the impingement plate has reduced effectiveness in the undercut region for cooling the side wall. To provide an effective impingement cooling flow in the undercut region for cooling the side wall, one or more openings are formed along the inturned edge of the impingement plate. Cooling inserts or receptacles are disposed in the openings and project into the undercut regions. Each receptacle has an open side which receives cooling medium flow from the first cavity between the cover and the impingement plate. The walls of the receptacle which project toward and lie in opposition to the nozzle side wall have apertures which are spaced sufficiently close to those walls to afford effective impingement cooling. Thus, the cooling medium flows from the first cavity, through the one or more openings of the inturned edge of the impingement plate, into the receptacle (s) and through the receptacle apertures for impingement cooling of the side wall and the nozzle wall portion in the undercut region. This affords effective cooling of the nozzle edge. An additional advantage of the use of receptacles resides in the flow of the spent cooling medium in flow areas between the inturned flange of the nozzle side wall and a wall of the receptacle toward a lower pressure area. This facilitates the flow of the cooling medium from the nozzle wall into the nozzle vane. It will be appreciated that the inner band portion of the nozzle segment has a similar cooling arrangement along its opposite side walls.

In a preferred embodiment according to the present invention, there is provided for use in a gas turbine, a nozzle segment having a band portion including a nozzle wall defining in part a hot gas path through the turbine, a cover spaced from the nozzle wall defining a chamber therebetween and an impingement plate disposed in the chamber defining with the cover a first cavity on one side of the impingement plate for receiving a cooling medium, the impingement plate on an opposite side thereof defining with the nozzle wall a second cavity, the impingement plate having a plurality of apertures for flowing cooling medium from the first cavity into the second cavity for impingement cooling the nozzle wall, the nozzle segment including a side wall including an inturned flange extending along the side wall defining with the side wall and nozzle wall an undercut region, and means projecting into the undercut region and toward the side wall for receiving cooling medium from the first cavity, the projecting means having a plurality of apertures therethrough for flowing cooling medium from the first cavity into the undercut region for impingement cooling a portion of the nozzle side wall.

In a further preferred embodiment according to the present invention, there is provided for use in a gas turbine, a nozzle segment having outer and inner band portions and at least one vane extending between the band portions, at least one of the band portions including a nozzle wall defining in part a hot gas path through the turbine, a cover radially spaced from the nozzle wall defining a chamber therebetween and an impingement plate disposed in the chamber defining with the cover a first cavity on one side of the impingement plate for receiving a cooling medium, the impingement plate on an opposite side thereof defining with the nozzle wall a second cavity, the impingement plate having a plurality of apertures for flowing cooling medium from the first cavity into the second cavity for impingement cooling the nozzle wall, the nozzle segment including a side wall extending generally radially between the nozzle wall and the cover and including an inturned flange defining an undercut region extending along the side wall and forming part of the second cavity, the impingement plate having an edge secured to the side wall and having at least one opening therethrough for communicating cooling medium from the first cavity into the undercut region, a receptacle open on one side disposed in the one opening for receiving cooling medium from the first cavity and extending into the undercut region toward the side wall, the receptacle having a plurality of apertures therethrough for flowing cooling medium received through the one opening into the undercut region for impingement cooling a portion of the nozzle side wall.

DETAILED DESCRIPTION OF THE INVENTION

Figure 1:
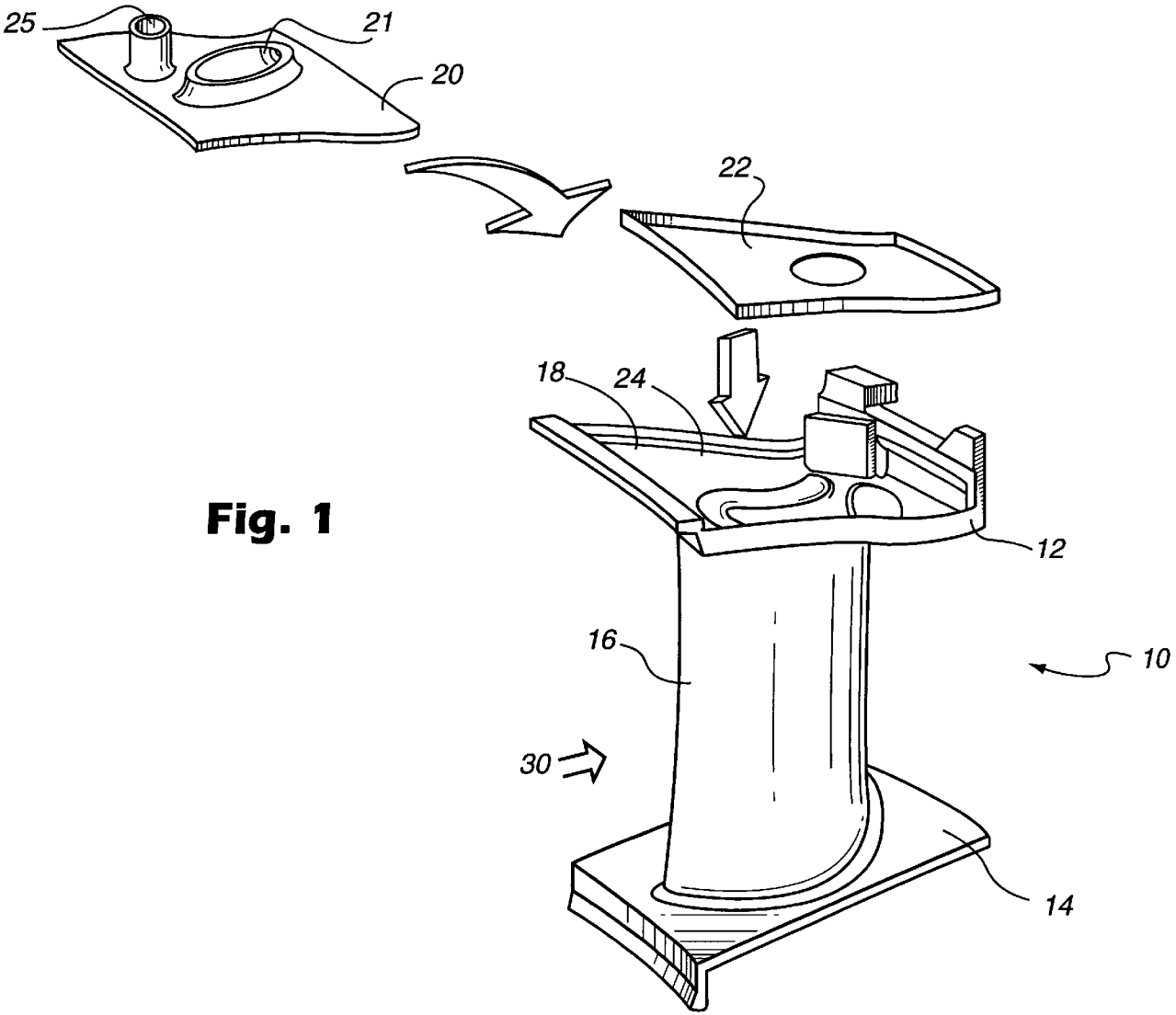
FIG. 1 is a perspective view of a nozzle vane segment with portions of the outer band broken away for clarity.
Figure 2:
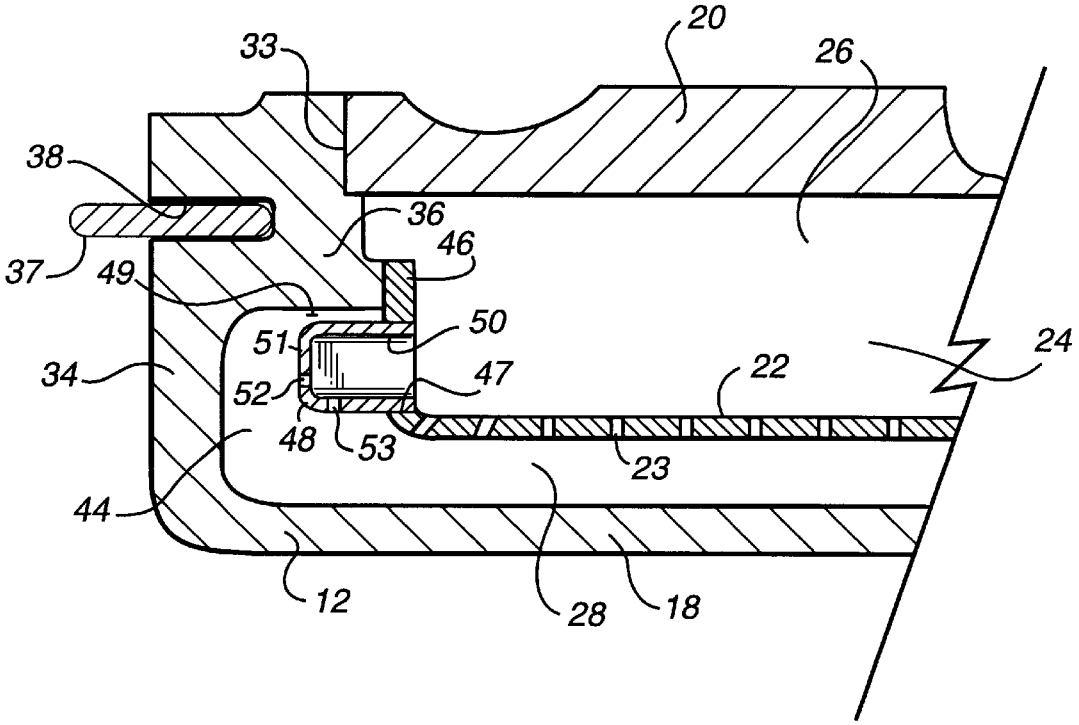
FIG. 2 is an enlarged fragmentary cross-sectional view of the side wall of a nozzle segment along either the inner band or the outer band.
Figure 3:
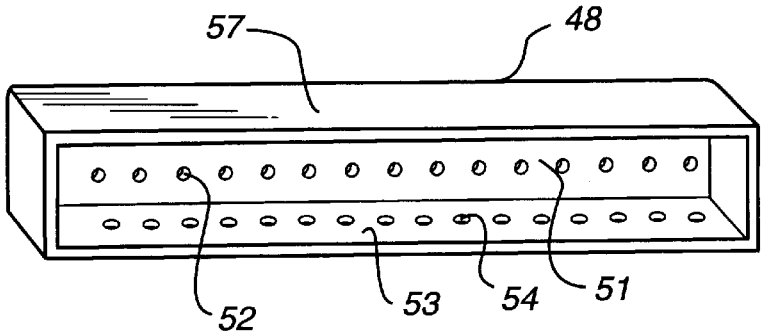
FIG. 3 is a perspective view of one of the cooling inserts or receptacles.

Referring now to the drawings, particularly to FIGS. 1 and 2, there is illustrated a nozzle stage segment, generally designated 10, forming part of an annular array of segments about the rotational axis of a gas turbine, not shown. Each nozzle segment 10 comprises an outer band portion 12, an inner band portion 14 and one or more vanes 16 extending between the outer and inner band portions 12 and 14, respectively. In the annular array of the nozzle segments, it will be appreciated that the side walls or edges of the outer and inner band portions lie directly adjacent side walls or edges of adjacent nozzle segments whereby the vanes 16 and the outer and inner bands form a complete annular array of nozzle segments about the rotor axis.

With reference to FIG. 1 the outer band portion 12 includes a nozzle wall 18 and an outer cover 20, both preferably cast. An impingement plate 22 is disposed in a chamber 24 formed between the nozzle wall 18 and the cover 20. As best illustrated in FIG. 2, a first cavity 26 is defined between the impingement plate 22 and cover 20 and a second cavity 28 is defined between the impingement plate 22 and nozzle wall 18. Referring back to FIG. 1, the nozzle segment design may be similar to that described and illustrated in U.S. Pat. No. 5,634,766, the disclosure of which is incorporated herein by reference, and details of the cooling circuit for the nozzle segment are not believed necessary to the present description. Suffice to say that the outer band portion 12 receives a cooling medium through a cooling medium inlet 21 in cover 20 for flow into the first cavity 26 and through apertures 23 in the impingement plate 22 into the second cavity 28 for impingement cooling nozzle wall 18. The cooling medium then flows from the second cavity 28 into inserts in cavities within the vane 16 for flow through apertures in the inserts for impingement cooling the walls of the vane. The cooling medium flows from the vane cavities into the first cavity (radially innermost cavity) of the inner band portion where it reverses direction for flow through an impingement plate in the inner band portion 14 and into the second cavity thereof for impingement cooling the inner nozzle wall 14. The spent cooling medium returns from the second cavity through a return cavity in the vane to an outlet 25 in the cover 20. Details of the cooling circuit are disclosed in the aforementioned U.S. patent to which reference is made for those details.

The cover 20 as illustrated in FIG. 2 is welded to the nozzle side wall 34 to form a weld joint 33 at a location a substantial distance from the hot gas path through the nozzle segment, as indicated by the arrow 30 in FIG. 1. As illustrated in FIG. 2, the nozzle side wall 34 extends generally radially of the nozzle wall 18 and lies adjacent a similar side wall 34 of an adjoining nozzle segment. The side wall 34 also includes an inturned flange 36. Flange 36 includes an edge spline seal slot 38 which receives an edge spline for sealing between adjacent nozzle segments. The weld joint 33 between the cover 20 and the nozzle side wall 34 is thus located a substantial distance from the hot gas path 30 and is subjected to lower temperatures than if located closer to the hot gas path, whereby weld joint 33 is not a limiting life factor for the design.

As illustrated in FIG. 2, the impingement plate 22 has a plurality of apertures 23 therethrough for flowing a cooling medium from the first cavity 26 into the second cavity 28 for impingement cooling the nozzle wall 18 along the hot gas path 30. The inturned flange 36, side wall 34 and a portion of the nozzle wall 12 define an undercut region 44. Because of this undercut region, the side wall 34 is difficult to cool with the typical impingement plate 22. In the present invention, the impingement plate 22 has an inturned edge 46 which is welded to an end face of the inturned flange 36 of the nozzle side wall 34. The inturned edge 46 is too far distant from the side wall edge 34 for effective impingement cooling by apertures formed through the inturned edge 46 and directed toward side wall 34.

In a preferred embodiment hereof, means projecting into the undercut region 44 and toward side wall 34 are provided for supplying cooling medium from the first cavity 26 into the undercut region 44 to cool the side wall 34. Such means may include flow channels extending into the region 44 through the inturned flange 36 or the flange 46 of the impingement plate 22 or both. The flow channels may comprise guides projecting from the flange 36 or impingement plate 22 for directing cooling flow from first cavity 24 toward side wall 34 for effective impingement cooling thereof.

In accordance with a preferred embodiment of the present invention and in order to impingement cool the side wall 34, one or more openings 47 are provided through the inturned edge 46 of impingement plate 22. The projecting means may comprise in the preferred embodiment an insert or receptacle 48 having an open end 50 and is secured adjacent open end 50 to the impingement plate 22 adjacent the opening 47 of the inturned edge 46. The side walls 51 and walls 53 facing nozzle wall 18 have apertures 52 and 54, respectively, which lie sufficiently close to the side wall 34 and portion of the nozzle wall 12 in the undercut region 44 to effectively impingement cool those wall portions. Thus, the cooling medium flowing into the first cavity 26 flows through the openings 47 of the inturned edge 46 of the impingement plate 22 into the receptacles or inserts 48 and through the apertures 52 and 54 for impingement cooling the side wall 34 and a portion of nozzle side wall 18 adjacent side wall 34 and opposite the insert 48.

The spent impingement cooling medium flows from the undercut region 44 and the second cavity 28 into the inserts in cavities of the vane. The flow region 49 between a wall 57 of receptacles 48 and the inturned flange 36 defines an area where the post-impingement cooling flow can flow to an area of lower pressure in a direction toward the vane cavities. Thus, the area 49 between the inturned flange 36.and the receptacle wall 57 reduces the cross-flow on the side wall 34 and enables post-impingement cooling flow to travel along the undercut region 44 to an area of lesser pressure for flow to the vane cavity.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. For use in a gas turbine, a nozzle segment having a band portion including a nozzle wall defining in part a hot gas path through the turbine, a cover spaced from said nozzle wall defining a chamber therebetween and an impingement plate disposed in said chamber defining with said cover a first cavity on one side of said impingement plate for receiving a cooling medium, said impingement plate on an opposite side thereof defining with said nozzle wall a second cavity, said impingement plate having a plurality of apertures for flowing cooling medium from said first cavity into said second cavity for impingement cooling said nozzle wall, said nozzle segment including a side wall including an inturned flange extending along said side wall defining with said side wall and nozzle wall an undercut region, and means projecting into said undercut region and toward said side wall for receiving cooling medium from said first cavity, said projecting means having a plurality of apertures therethrough for flowing cooling medium from said first cavity into said undercut region for impingement cooling a portion of said nozzle side wall.

2. A nozzle segment according to claim 1 wherein said impingement plate has an inturned edge extending generally toward said cover and said projecting means projects from said inturned edge in a direction toward said side wall.

3. A nozzle segment according to claim 2 wherein said impingement plate is secured to said inturned flange.

4. A nozzle segment according to claim 1 wherein said cover is welded to said nozzle side wall along said inturned flange.

5. A nozzle segment according to claim 1 wherein said impingement plate has a plurality of openings therealong spaced one from another, said projecting means including a plurality of receptacles open on one side disposed in said openings, respectively, for receiving cooling medium from said first cavity and extending into said undercut region toward said side wall, said receptacles having a plurality of apertures therethrough for flowing cooling medium received through said plurality of openings into said undercut region for impingement cooling a portion of said nozzle side wall.

6. A nozzle segment according to claim 5 wherein said impingement plate has an edge inturned generally toward said cover and said receptacles project from said inturned edge in a direction generally toward said side wall.

7. A nozzle segment according to claim 6 wherein said cover is welded to said nozzle side wall along said inturned flange and forms a weld joint therewith, said weld joint lying on a side of said inturned flange, said receptacles and said nozzle wall portion remote from said hot gas path.

8. A nozzle segment according to claim 5 wherein each said receptacle includes walls respectively spaced from the nozzle wall, the nozzle side wall and said inturned flange, said inturned flange and one of said receptacle walls defining a flow chamber for reducing cross-flow along the nozzle side wall edge in the undercut region, enabling post-impingement flow along the side wall to an area of lesser pressure.

9. A nozzle segment according to claim 1 wherein said impingement plate has at least one side opening, said projecting means including at least one receptacle open on one side and disposed in said at least one opening, said receptacle having apertures positioned for directing flow of the cooling medium onto the nozzle side wall for impingement cooling thereof.

10. For use in a gas turbine, a nozzle segment having outer and inner band portions and at least one vane extending between said band portions, at least one of said band portions including a nozzle wall defining in part a hot gas path through the turbine, a cover radially spaced from said nozzle wall defining a chamber therebetween and an impingement plate disposed in said chamber defining with said cover a first cavity on one side of said impingement plate for receiving a cooling medium, said impingement plate on an opposite side thereof defining with said nozzle wall a second cavity, said impingement plate having a plurality of apertures for flowing cooling medium from said first cavity into said second cavity for impingement cooling said nozzle wall, said nozzle segment including a side wall extending generally radially between said nozzle wall and said cover and including an inturned flange defining an undercut region extending along said side wall and forming part of said second cavity, said impingement plate having an edge secured to said side wall and having at least one opening therethrough for communicating cooling medium from said first cavity into said undercut region, a receptacle open on one side disposed in said at least one opening for receiving cooling medium from said first cavity and extending into said undercut region toward said side wall, said receptacle having a plurality of apertures therethrough for flowing cooling medium received through said at least one opening into said undercut region for impingement cooling a portion of said nozzle side wall.

11. A nozzle segment according to claim 10 wherein said edge of said impingement plate is inturned generally toward said cover and said receptacle projects from said inturned edge in a direction generally normal to a radial direction.

12. A nozzle segment according to claim 11 wherein said inturned edge is secured to said inturned flange.

13. A nozzle segment according to claim 10 wherein said cover is welded to said nozzle side wall along said inturned flange.

14. A nozzle segment according to claim 10 wherein said edge of said impingement plate has a plurality of openings therealong spaced one from another, and a plurality of receptacles open on one side disposed in said openings, respectively, for receiving cooling medium from said first cavity and extending into said undercut region toward said side wall, said receptacles having a plurality of apertures therethrough for flowing cooling medium received through said plurality of openings into said undercut region for impingement cooling a portion of said nozzle side wall.

15. A nozzle segment according to claim 14 wherein said edge of said impingement plate is inturned generally toward said cover and said receptacles project from said inturned edge in a direction generally normal to a radial direction.

16. A nozzle segment according to claim 15 wherein said cover is welded to said nozzle side wall along said inturned flange and lies generally radially to one side of said inturned flange, said receptacles and said nozzle side wall portion.

17. A nozzle segment according to claim 10 wherein said receptacle includes walls respectively spaced from the nozzle wall, the nozzle side wall and said inturned flange, said inturned flange and one of said receptacle walls defining a flow chamber for reducing cross-flow along the nozzle side wall in the undercut region, enabling post-impingement flow along the side wall to an area of lesser pressure.

18. A nozzle segment according to claim 10 wherein said receptacle has apertures positioned for directing flow of the cooling medium onto the nozzle side wall for impingement cooling thereof.

* * * * *